US006344782B1

(12) United States Patent
Yang

(10) Patent No.: US 6,344,782 B1
(45) Date of Patent: Feb. 5, 2002

(54) DRY TYPE VACUUM CLEANER/SANDER SWITCHING ADAPTER

(76) Inventor: Jim Chi Hsiang Yang, 7242 Teresa Ave., South San Gabriel, CA (US) 91770

( * ) Notice: Subject to any disclaimer, the term of this patent is extended or adjusted under 35 U.S.C. 154(b) by 0 days.

(21) Appl. No.: 09/883,285

(22) Filed: Jun. 19, 2001

(51) Int. Cl.[7] ..... H01H 9/00
(52) U.S. Cl. ..... 335/205
(58) Field of Search ..... 335/205–208, 335/151–154

*Primary Examiner*—Ramon M. Barrera
(74) *Attorney, Agent, or Firm*—Rosenberg, Klein & Lee

(57) ABSTRACT

A dry type vacuum cleaner/sander switching adapter is constructed to include a pneumatic control unit and a relay air. When operating the sander, compressed air passes to the sander through the pneumatic control unit, and a solenoid switch is induced to switch on a dry type vacuum cleaner, causing the dry type vacuum cleaner to suck in dust from the sander. When turning off the sander, the solenoid switch is driven to cut off power supply from the dry type vacuum cleaner.

5 Claims, 7 Drawing Sheets

DRY TYPE VACUUM CLEANER/SANDER SWITCHING ADAPTER

BACKGROUND OF THE INVENTION

The present invent relates to a dry type vacuum cleaner/sander switching adapter, which automatically switches on the dry type vacuum cleaner to suck in dust from the sander upon operation of the sander.

The frame of a motor vehicle body must be ground several times before coating. During sanding, much dust is produced. Therefore, a big scale automatic vacuum-cleaning machine must be used to remove dust when sanding the frame of a motor vehicle body. However, using a big scale automatic vacuum-cleaning machine has numerous drawbacks as outlined hereinafter.

1. Because the big scale automatic vacuum cleaning machine must run continuously all day long, much power energy is wasted in case only one or two of the work stations are in operation.
2. The installation cost of the big scale automatic vacuum-cleaning machine is high.
3. During operation, the big scale automatic vacuum-cleaning machine produces high noise.

SUMMARY OF THE INVENTION

The present invention has been accomplished under the circumstances in view. The invention achieves the following advantages:

1. The sander and the dry type vacuum cleaner can be matched together as desired, enabling the dry type vacuum cleaner to suck in dust from the sander during the operation of the sander.
2. The sander and the dry type vacuum cleaner are highly movable, and can be freely used at different locations.
3. Because the sander and the dry type vacuum cleaner are for use by an individual, they consume less power supply.
4. The air tube of the sander and the air hose of the dry type vacuum cleaner are arranged together so that the user can carry the sander and the dry type vacuum cleaner to the desired place conveniently.

The dry type vacuum cleaner/sander switching adapter of the present invention comprises a pneumatic control unit, the pneumatic control unit comprising an air input passageway, the air input passageway having a first end mounted with a pipe connector connected to an air compressor to receive compressed air from the air compressor and a second end sealed with a screw cap, an air output passageway disposed in communication with the air input passageway for output of compressed air from the air compressor to the air input tube of a sander, and an elongated hole disposed in parallel to the air input passageway; a spring member mounted in the air input passageway and supported on the screw cap; a plug member supported on the spring and forced by the spring member to close the passage between the air input passageway and the air output passageway, the plug member holding a magnet on the inside; a solenoid switch mounted the elongated hole of the pneumatic control unit and connected to negative pole of power supply; and a relay, the relay having an input end connected to negative pole of power supply through the solenoid switch and an output end connected to positive pole of power supply through the negative terminal of the motor of a dry type vacuum cleaner and then the positive terminal of the motor; wherein the solenoid switch is off when the pneumatic control unit receives no air from said air compressor; when the sander is turned on, the air compressor outputs compressed air to the air input passageway to force the plug member backwards against the spring member, for enabling compressed air to pass from the air input passageway to the air output passageway and then said sander, and at the same time the magnet induces the solenoid switch to close negative pole of power supply and to let electric current pass to the motor of the dry type vacuum cleaner, causing the dry type vacuum cleaner to suck in dust from the sander; when turning off the air compressor and the sander, the spring member forces the plug member forwards to close the air passage between the air input passageway and the air output passageway, and the solenoid switch is switched off to cut off power supply from the motor of the dry type vacuum cleaner.

DETAILED DESCRIPTION OF THE PREFERRED EMBODIMENT

Figure 1:
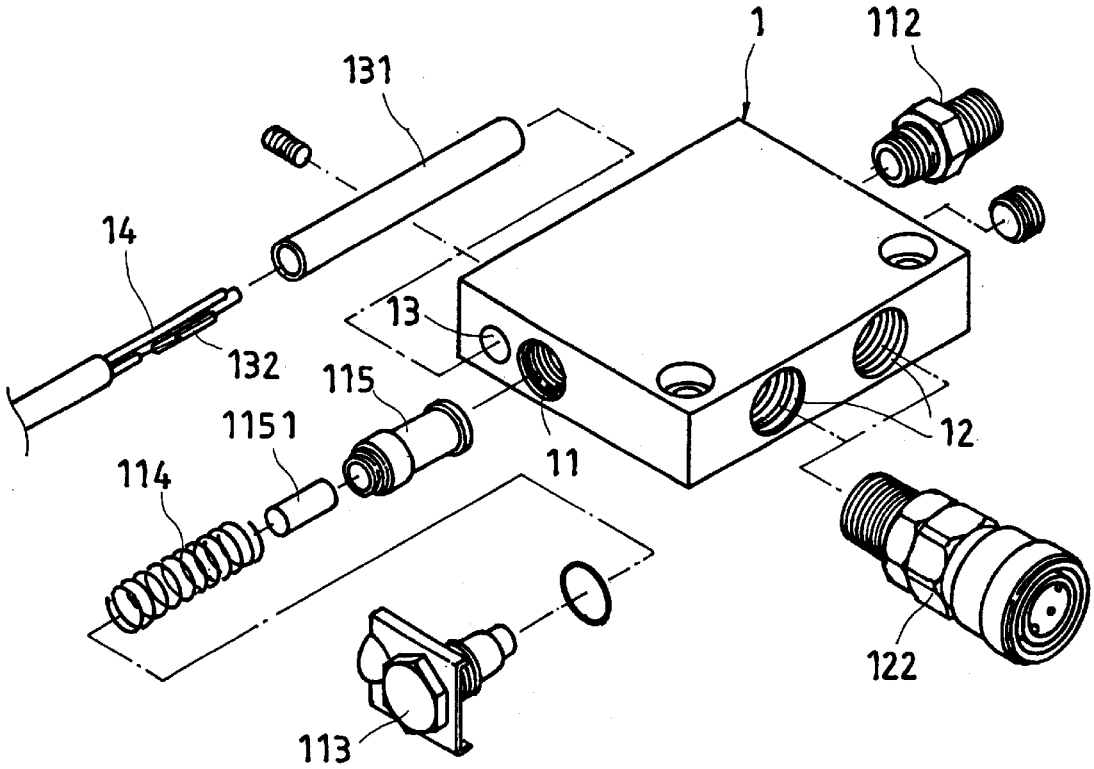
FIG. 1 is an exploded view of a pneumatic control unit for a dry type vacuum cleaner/sander switching adapter according to the present invention.

Referring to FIGS. from 1 through 5, a dry type vacuum cleaner/sander switching adapter is shown comprised of a pneumatic control unit 1 and a relay 2. The pneumatic control unit 1 comprises an air input passageway 11 and an air output passageway 12. The air output passageway 12 has an inner end 121 disposed in communication with one end 111 of the air input passageway 11. The end 111 of the air input passageway 11 is fixedly mounted with a pipe connector 112, which receives the air hose 31 of an air compressor 3. The other end of the air input passageway 11 is sealed with a screw cap 113. The screw cap 113 holds one end of a spring 114 inside the air input passageway 11. A plug member 115 is supported on the spring 114, having a magnet 1151 mounted on the inside. When the air input passageway 11 receives no air pressure, the plug member 115 is forced forwards by the spring 114 to seal the air passage between the air input passageway 11 and the air output passageway 12. An elongated hole 13 is formed in the pneumatic control unit 1 in parallel to the air input passageway 11. A sleeve 131 is mounted in the elongated hole 13. A reed switch 132 is mounted in the sleeve 131. The power supply negative line 14 is connected to the reed switch 132 and then the input end 21 of the relay 2. The power supply positive line 15 is connected to the positive terminal of the motor 41 of the dry type vacuum cleaner 4. The reed switch 132 is off when the pneumatic control unit 1 receives no air pressure; therefore the power supply negative line 15 is opened. When pressing on the air input control valve of the sander 5, compressed air passes into the air input passageway 11 of the pneumatic control unit 1 to move the plug member 115 away from the air passage between the air input passageway 11 and the air output passageway 12 and to compress the spring 114, enabling compresses air to pass from the air input passageway 11 into the inner end 121 of the air output passage way 12, and then to pass from the air output passageway 12 to the sander 5 through an air tube 51. At this time, the magnet 1151 induces the reed switch 132 to close the power supply negative line 14, enabling electricity to pass in proper order through the power supply negative line 14, the input end 21 of the relay 2, and the output end 22 of the relay 2 to the motor 41 of the dry type vacuum cleaner 4, and therefore dust is sucked from the sander 5 into the dry type vacuum cleaner 4 through the hose 42 being connected between the sander 5 and the dry type vacuum cleaner 4 during the operation of the sander 5. When the sander 5 stopped, compressed air is released from the plug member 115, and the plug member 115 is forced forwards to close the air passage between the air input passageway 11 and the air output passageway 12, and at the same time the reed switch 132 is switched off (because the magnet 1151 is moved with the plug member 115 away from the induction area of the solenoid switch 132) to open the power supply negative line 14 and the cut off power supply from the motor 41 of the dry type vacuum cleaner 4. There is provided a three-position switch 43. When switching the three-position switch 43 to the first position, the power supply positive and negative lines are connected to the motor 41 of the dry type vacuum cleaner 4 for enabling the dry type vacuum cleaner 4 to function independently. When switching the three-position switch 43 to the second position, namely, the auto position, the power supply negative line 14 is switched between on/off positions by the reed switch 132 subject to the status of the pneumatic control unit 1. When switching the three-position switch 43 to the third position, namely, the off position, the power supply negative line 14 and the power supply positive line 15 are opened. Further, at least one quick connector 122 is installed in the air output passageway 12 for the connection of the air tube 51 of the sander 5. The middle part of the air tube 51 is arranged with the air hose 42 together.

FIGS. from 6 through 8 show an alternate form of the present invention. According to this alternate form, the pneumatic control unit 1 and the relay 2 are mounted in a case 6. The case 6 has an electric socket 61 and a three-position switch 62. The power supply positive line 15 and the power supply negative line 14 are connected to the electric socket 61. When using the sander 5, the power cord of the dry type vacuum cleaner 4 is connected to the electric socket 61, and the air hose 31 of an air compressor 3 and the air tube 51 of the sander 5 are respectively connected to the pipe connector 112 of the air input passageway 11 and the quick connector 122 in the air output passageway 12. When in use, compressed air passes through the air input passageway 11 and then the air output passageway 12 to the air tube 51 of the sander 5, and at the same time the reed switch 132 is switched on to close the power supply negative line 14 and to let electric current passes through the relay 2 to the electric socket 61 and then to the motor 41 of the dry type vacuum cleaner 4. When turning off the sander 5, the plug member 115 is forced forwards to close the air passage between the air input passageway 11 and the air output passageway 12, and the solenoid switch 132 is switched off to open the power supply negative line 14 and to cut off power supply from the dry type vacuum cleaner 4. The three-position switch 62 functions in the same manner as the aforesaid three-position switch 43.

Figure 6:
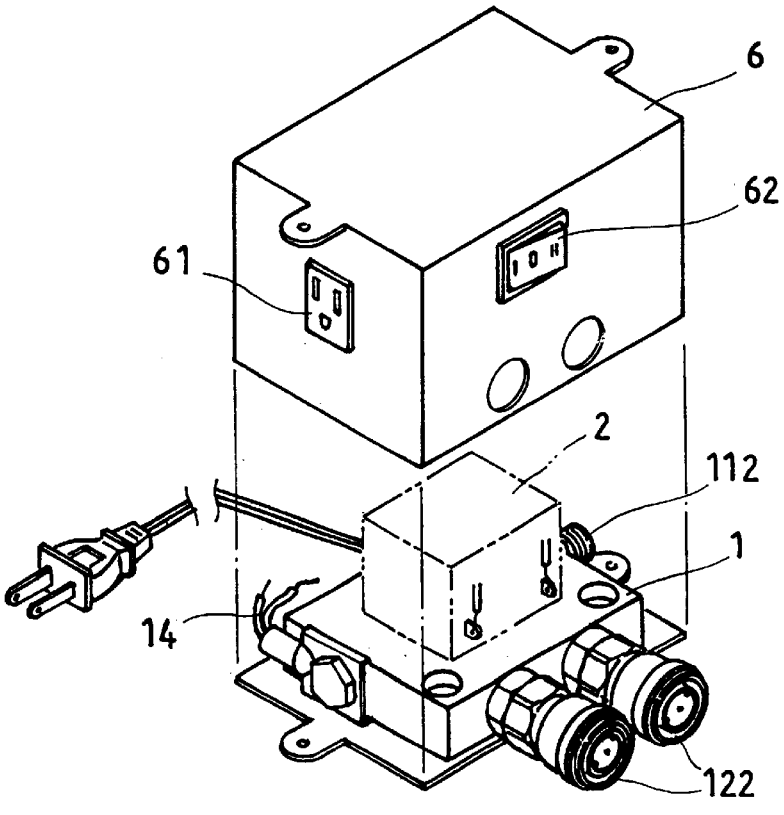
FIG. 6 is an exploded view of a dry type vacuum cleaner/sander switching adapter according to a second embodiment of the present invention.
Figure 2:
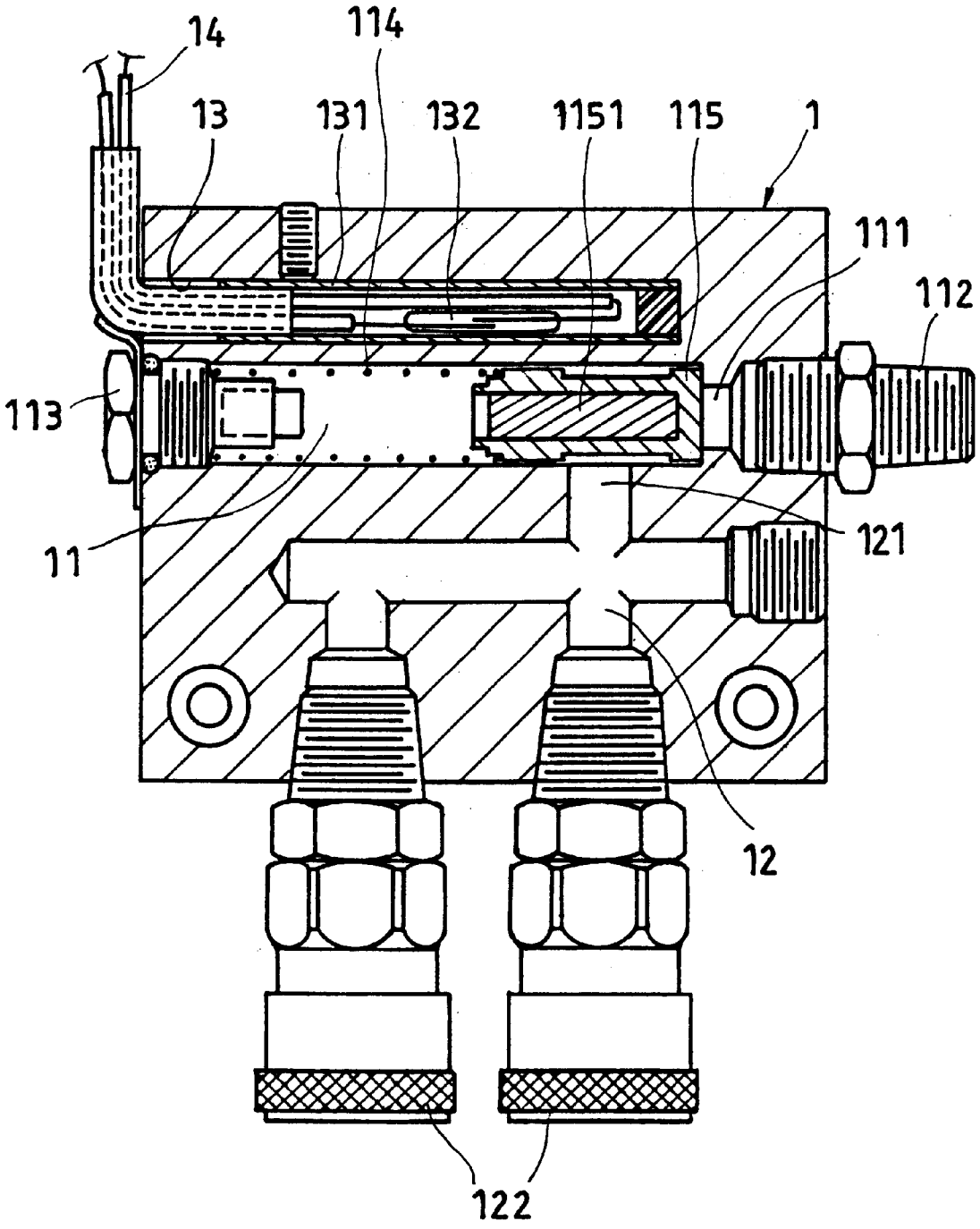
FIG. 2 is a sectional assembly view in an enlarged scale of the pneumatic control unit of FIG. 1.
Figure 3:
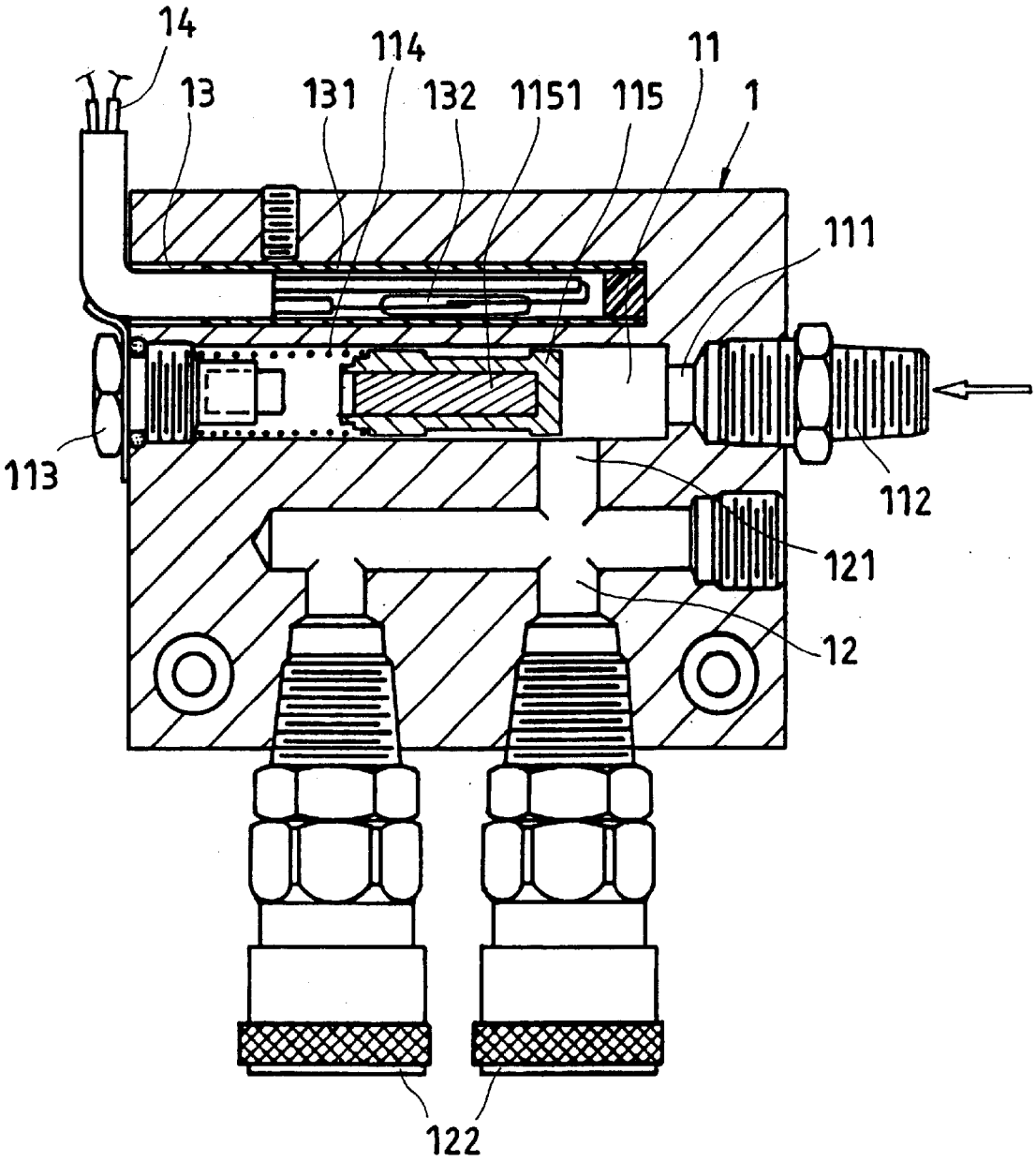
FIG. 3 is similar to FIG. 2 but showing the plug member moved away from the air passage between the air input passageway and the air output passageway.
Figure 4:
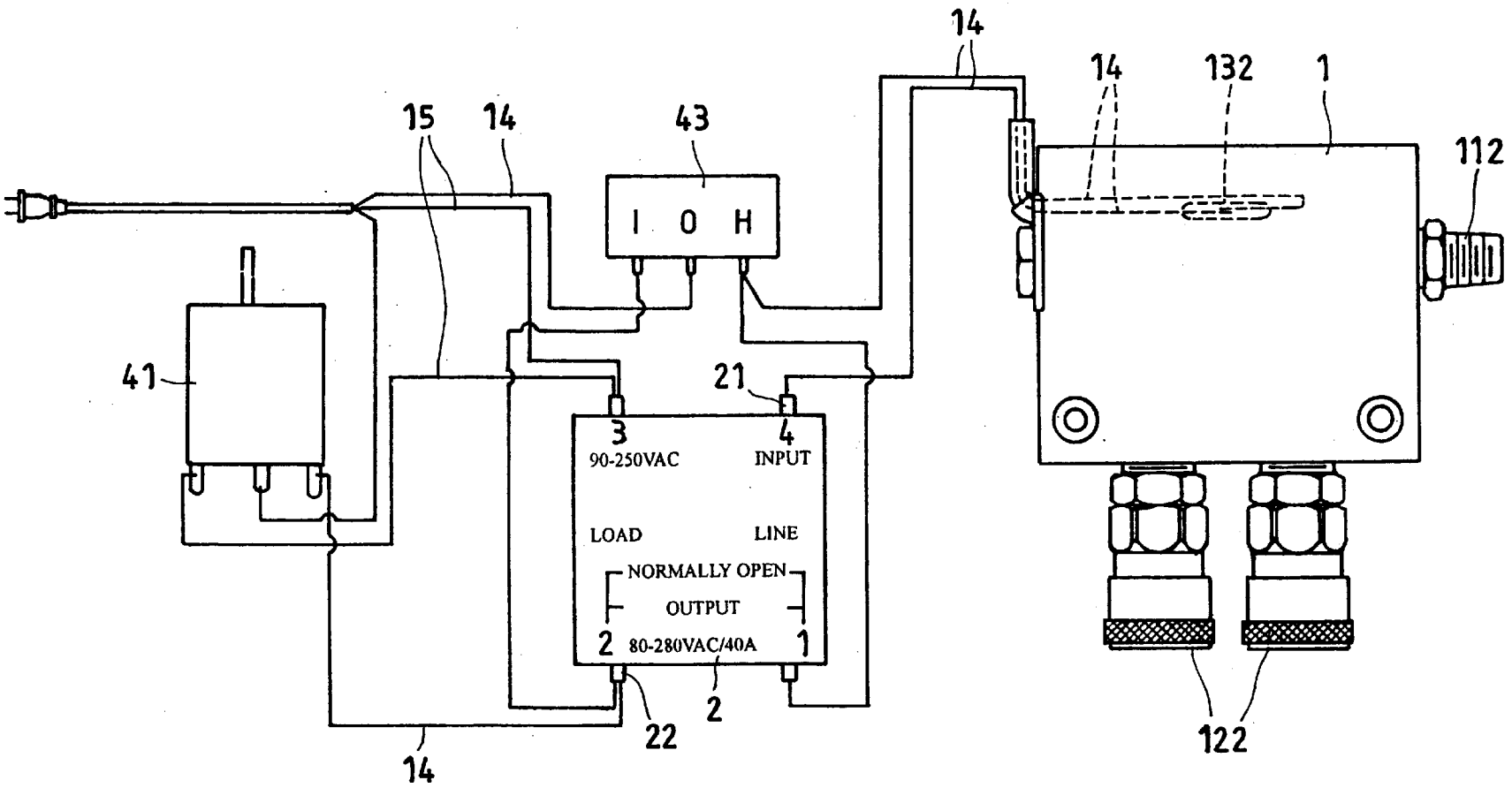
FIG. 4 illustrates the arrangement of power circuit according to the present invention.
Figure 5:
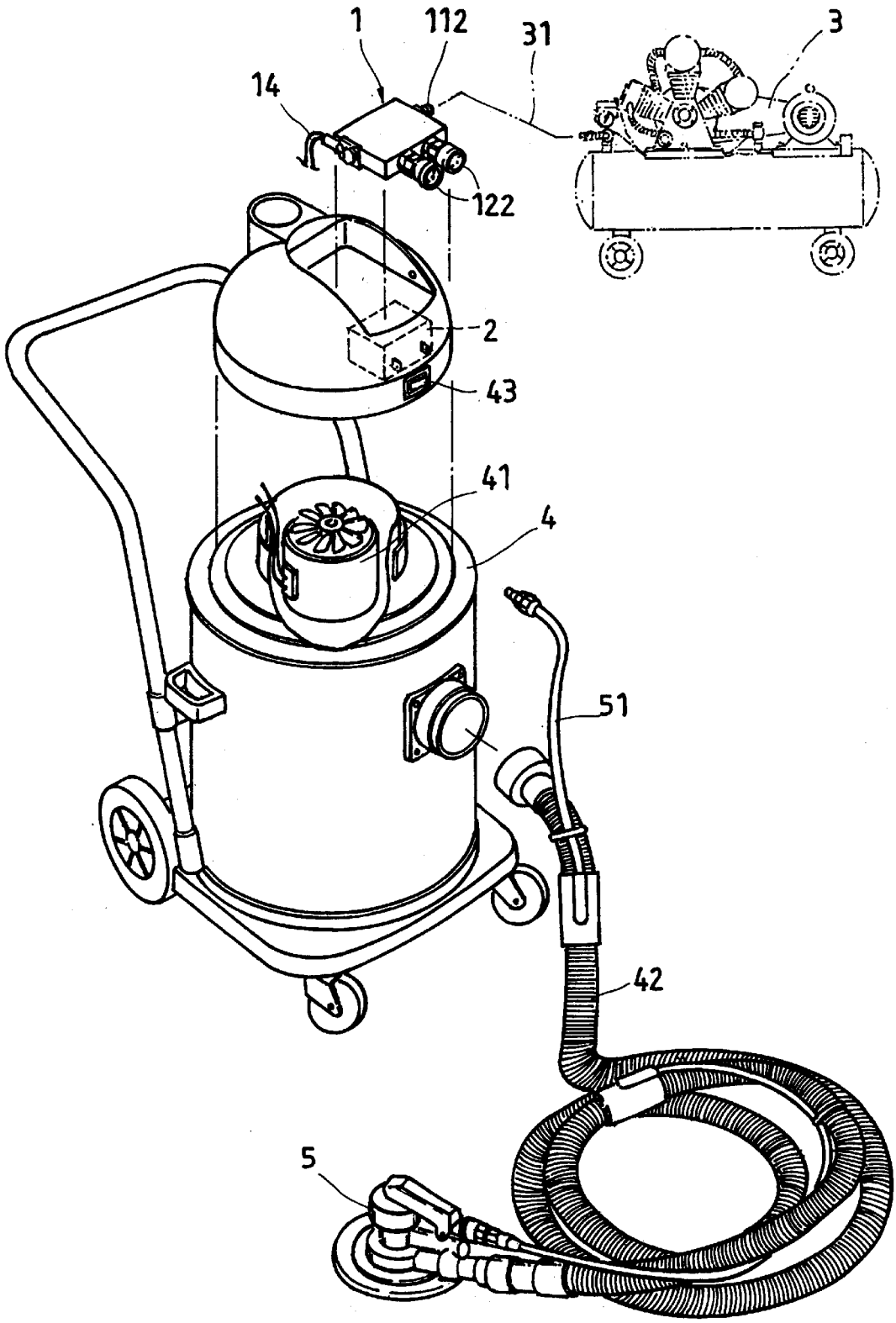
FIG. 5 is an exploded view showing the relationship between the dry type vacuum cleaner/sander switching adapter, the air compressor, the dry type vacuum cleaner, and the sander according to the present invention.
Figure 7:
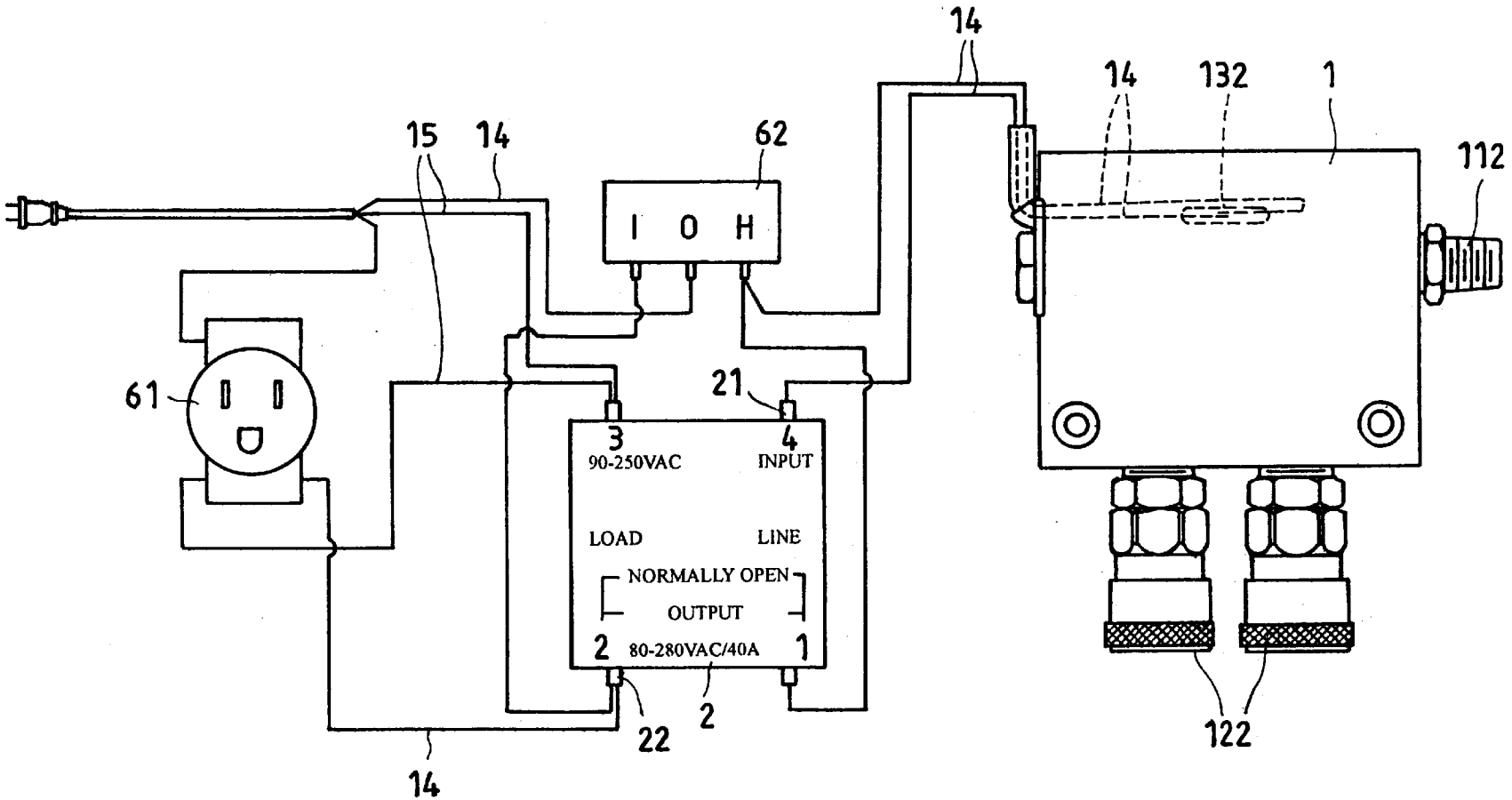
FIG. 7 illustrates the arrangement of power circuit according to the second embodiment of the present invention.
Figure 8:
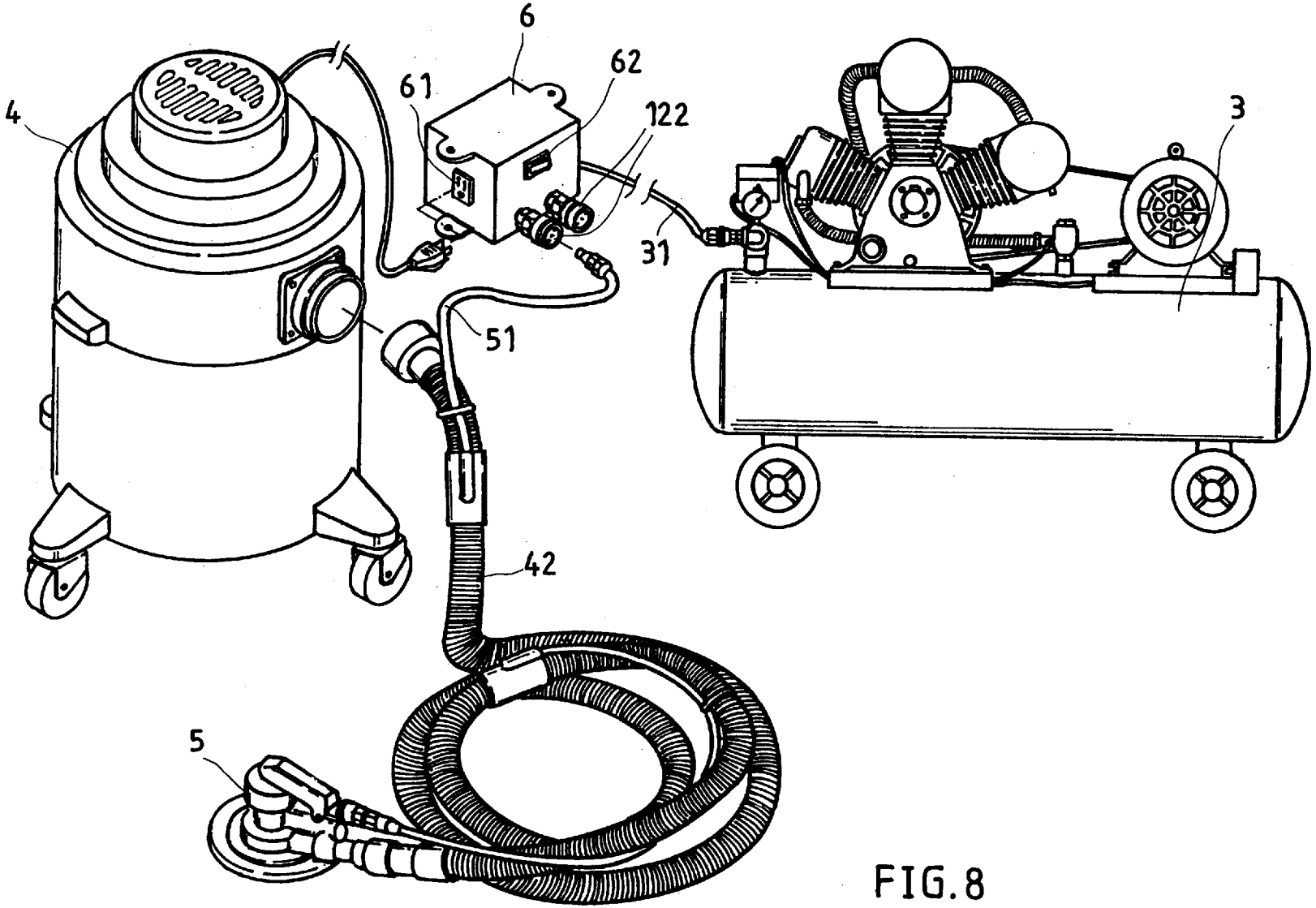
FIG. 8 is an exploded view showing the relationship between the dry type vacuum cleaner/sander switching adapter, the air compressor, the dry type vacuum cleaner, and the sander according to the second embodiment of the present invention.

A prototype of dry type vacuum cleaner/sander switching adapter has been constructed with the features of FIGS. 1~18. The dry type vacuum cleaner/sander switching adapter functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A dry type vacuum cleaner/sander switching adapter comprising:

a pneumatic control unit, said pneumatic control unit comprising an air input passageway, said air input passageway having a first end mounted with a pipe connector connected to an air compressor to receive compressed air from said air compressor and a second end sealed with a screw cap, an air output passageway disposed in communication with said air input passageway for output of compressed air from said air compressor to the air input tube of a sander, and an elongated hole disposed in parallel to said air input passageway;

a spring member mounted in said air input passageway and supported on said screw cap;

a plug member supported on said spring and forced by said spring member to close the passage between said air input passageway and said air output passageway, said plug member holding a magnet on the inside;

a reed switch mounted in the elongated hole of said pneumatic control unit and connected to negative pole of a power supply; and a relay, said relay having an input end connected to negative pole of said power supply through said solenoid switch and an output end connected to positive pole of said power supply through the negative terminal of the motor of a dry type vacuum cleaner and then the positive terminal of the motor;

wherein said reed switch is off when said pneumatic control unit receives no air from said air compressor; when said sander is turned on, said air compressor outputs compressed air to said air input passageway to force said plug member backwards against said spring member, for enabling compressed air to pass from said air input passageway to said air output passageway and then said sander, and at the same time said magnet induces said reed switch to close negative pole of said power supply and to let electric current pass to said motor of said dry type vacuum cleaner, causing said dry type vacuum cleaner to suck in dust from said sander; when turning off said air compressor and said sander, said spring member forces said plug member forwards to close the air passage between said air input passageway and said air output passageway, and said reed switch is switched off to cut off said power supply from said motor of said dry type vacuum cleaner.

2. The dry type vacuum cleaner/sander switching adapter of claim 1 further comprising a three-position switch alternatively switched between a first position where positive and negative poles of said power supply are directly connected to said motor of said dry type vacuum cleaner, a second position where negative pole of said power supply is controlled by said reed switch, and a third position where said power supply is off.

3. The dry type vacuum cleaner/sander switching adapter of claim 1 further comprising a quick connector installed in said air output passageway for the connection of the air tube of said sander.

4. The dry type vacuum cleaner/sander switching adapter of claim 1 further comprising a sleeve mounted in said elongated hole of said pneumatic control unit to hold said reed switch on the inside.

5. The dry type vacuum cleaner/sander switching adapter of claim 1 further comprising a case holding said pneumatic control unit and said relay on the inside, said case comprising an electric socket, which receives the power cord of said dry type vacuum cleaner.

* * * * *